US005797325A

United States Patent [19]

Ebina et al.

[11] Patent Number: 5,797,325

[45] Date of Patent: Aug. 25, 1998

[54] CYLINDER CLEANING APPARATUS FOR PRINTING PRESS

[75] Inventors: Toshihiko Ebina; Takeshi Asai, both of Ibaragi, Japan

[73] Assignee: Komori Corporation, Japan

[21] Appl. No.: 677,509

[22] Filed: Jul. 10, 1996

[30] Foreign Application Priority Data

Jul. 11, 1995 [JP] Japan ..... 7-174626

[51] Int. Cl.[6] ..... B41F 35/00

[52] U.S. Cl. ..... 101/425; 101/423

[58] Field of Search ..... 101/423, 424, 101/425; 15/256.52, 256.51

[56] References Cited

U.S. PATENT DOCUMENTS

| | | | |
|---|---|---|---|
| 4,986,182 | 1/1991 | Sawaguchi et al. | 101/423 |
| 5,309,836 | 5/1994 | Takeuchi | 101/423 |
| 5,325,779 | 7/1994 | Ebina | 101/425 |
| 5,325,780 | 7/1994 | Matsuda et al. | 101/425 |
| 5,515,782 | 5/1996 | Ebina et al. | 101/424 |

FOREIGN PATENT DOCUMENTS 4-135240 12/1992 Japan .

6-67031 9/1994 Japan .

*Primary Examiner*—Edgar S. Burr
*Assistant Examiner*—Anthony H. Nguyen
*Attorney, Agent, or Firm*—Blakely, Sokoloff, Taylor & Zafman

[57] ABSTRACT

A cylinder cleaning apparatus for a printing press includes a cleaning unit, an actuator, another actuator, and a control unit. The cleaning unit is supported by a printing press frame to be movable between a cleaning position where a cleaning web is in contact with a circumferential surface of a cylinder and a retreat position where the cleaning web is separate from the circumferential surface of the cylinder. The cleaning unit has a cleaning cloth supply roll for supplying the cleaning web to the circumferential surface of the cylinder and a cleaning cloth take-up roll for taking up the cleaning web supplied from the cleaning cloth supply roll. The actuator is fixed to the printing press frame to pivot the take-up roll for a predetermined amount, thereby taking up the cleaning web. Another actuator moves the cleaning unit to one of the cleaning position and the retreat position in accordance with whether the cylinder is in a first or second cleaning mode. The control unit controls at least one of the two actuators in accordance with a position of the cleaning unit to set take-up amounts of the cleaning web to be taken up by the take-up roll in the first and second cleaning modes to be substantially equal to each other.

17 Claims, 11 Drawing Sheets

FIG. 7A SLOW-ACTING BUTTON 5
FIG. 7B PRINTING PRESS MOTOR 15
FIG. 7C SIMULTANEOUS CLEANING BUTTON 4
FIG. 7D SOLENOID VALVE 7
FIG. 7E SOLENOID VALVE 8
FIG. 7F THIRD TIMER 13
FIG. 7G FOURTH TIMER 14

FIG. 8A LOW-SPEED BUTTON 6
FIG. 8B PRINTING PRESS MOTOR 15
FIG. 8C SINGLE CLEANING BUTTON 3
FIG. 8D UNIT THROW-ON / THROW-OFF SOLENOID VALVE 7
FIG. 8E SOLENOID VALVE 8
FIG. 8F FIRST TIMER 11
FIG. 8G SECOND TIMER 12

CYLINDER CLEANING APPARATUS FOR PRINTING PRESS

BACKGROUND OF THE INVENTION

The present invention relates to a cylinder cleaning apparatus for various types of printing presses, which cleans the circumferential surfaces of printing cylinders, e.g., a plate cylinder, a blanket cylinder, an impression cylinder, and a transfer cylinder, and rollers, e.g., a form roller and a vibrating roller.

Various types of printing presses, e.g., an offset printing press and an intaglio printing press, have printing cylinders, e.g., a plate cylinder, a blanket cylinder, an impression cylinder, and a transfer cylinder, and rollers, e.g., a form roller and a vibrating roller. During printing, foreign matters, e.g., ink dust and paper dust attach to the circumferential surfaces of these printing cylinders and rollers to degrade the quality of printed matter. Hence, the printing press is generally provided with a cylinder cleaning apparatus for removing these foreign matters. This cylinder cleaning apparatus is roughly constituted by a belt-like cleaning web, a cleaning unit, a cloth take-up actuator, and a unit throw-on/throw-off actuator. The cleaning web is made of an unwoven fabric or the like on which a cleaning liquid is injected to wipe the foreign matters on the circumferential surfaces of the cylinders. The cleaning unit has a supply roller and a take-up roller for respectively supplying and taking up the cleaning web. The cloth take-up actuator drives the take-up roller to rotate so as to take up the cleaning web. The unit throw-on/throw-off actuator moves the cleaning unit toward and away from the circumferential surfaces of the cylinders to cause the cleaning web to come into contact with or to separate from the circumferential surfaces of the cylinders.

Cloth take-up actuators are roughly classified into those each having a fixing structure fixed to the cleaning unit, and those each having a fixing structure fixed to the printing press frame, as shown in Japanese Utility Model Laid-Open No. 6-67031. In a cloth take-up actuator of the type having a fixing structure fixed to the cleaning unit, the cleaning unit must sometimes be removed when exchanging the cleaning web of the cleaning unit, the cleaning unit itself, or a blanket wound on the blanket cylinder. In these cases, since the actuator fixed to the cleaning unit is heavy, the exchange operation takes time and the operation of removing the pipe of the actuator is cumbersome. For these reasons, the cloth take-up actuator having a fixing structure fixed to the printing press frame, as shown in the above reference, is popular.

The cleaning methods are classified into a method of cleaning only the blanket cylinder and a method of cleaning the blanket cylinder and the impression cylinder simultaneously, and these two cleaning methods are selectively used. In the former cleaning method, the rotation of the printing press during cleaning is set relatively fast (this state will be referred to as a low-speed state hereinafter). In the latter cleaning method, a gripper escaping mechanism (see Japanese Utility Model Laid-Open No. 4-135340) for escaping the entire cleaning unit from the circumferential surface of the impression cylinder is provided in order to escape the cleaning unit from a gripper projecting from the circumferential surface of the impression cylinder. Because of this structure, the rotation of the printing press is set low (this state will be referred to as a slow-acting state hereinafter). In this manner, since the printing press has two different rotation speeds for cleaning, when the cleaning web is to be taken up, the cleaning web must be in contact with or separate from the circumferential surfaces of the cylinders in accordance with whether only the blanket cylinder is to be cleaned or both the blanket cylinder and the impression cylinder are to be cleaned simultaneously. More specifically, when only the blanket cylinder is to be cleaned in the low-speed state, if the cleaning unit is located at a cleaning position to set the cleaning web in contact with the circumferential surface of the cylinder, wrinkles are formed on the cleaning web to cause defective cleaning. In order to prevent this, the cleaning unit is located at a retreat position to set the cleaning web separate from the circumferential surface of the cylinder. In contrast to this, when both the blanket cylinder and the impression cylinder are to be cleaned simultaneously in the slow-acting state, the cleaning unit is located at the cleaning position to set the cleaning web in contact with the circumferential surfaces of the cylinders.

When supplying a clean portion of the cleaning cloth, the pin of a take-up lever which is fitted on the cloth take-up shaft supported by the cleaning unit through a one-way clutch and biased is pivoted repeatedly for a predetermined count by an actuator supported by the frame, and the soiled portion of the cleaning cloth is taken up by the take-up roll of the cloth take-up shaft, thereby supplying the clean portion of the cleaning cloth for a predetermined amount.

When, however, only the blanket cylinder is to be cleaned in the low-speed state, as the cleaning unit is located at the retreat position, a gap is formed between the distal end of the rod of the actuator and the pin of the take-up lever in the prescribed state to decrease the pivot amount of the cloth take-up lever obtained upon one stroke of the rod. More specifically, the cloth take-up amount in the low-speed state obtained upon one operation of the actuator is smaller than that in the slow-acting state. As a result, in a conventional cylinder cleaning apparatus which takes up the cleaning cloth by repeatedly actuating the actuator for the same count both in the low-speed state and the slow-acting state, the entire cloth take-up amount in the low-speed state becomes insufficient and a sufficient amount of clean portion of the cleaning cloth is not supplied to the circumferential surface of the blanket cylinder, thereby causing defective cleaning.

SUMMARY OF THE INVENTION

It is an object of the present invention to provide a cylinder cleaning apparatus for a printing press, which sufficiently supplies a clean portion of a cleaning cloth regardless of whether the cleaning unit is in the low-speed state or the slow-acting state, thereby improving the cleaning capability.

In order to achieve the above object, according to the present invention, there is provided a cylinder cleaning apparatus for a printing press, comprising a cleaning unit supported by a printing press frame to be movable between a cleaning position where a cleaning web is in contact with a circumferential surface of a cylinder and a retreat position where the cleaning web is separate from the circumferential surface of the cylinder, the cleaning unit having a supply portion for supplying the cleaning web to the circumferential surface of the cylinder and a take-up roll for taking up the cleaning web supplied from the supply portion, a first actuator fixed to the printing press frame to pivot the take-up roll for a predetermined amount, thereby taking up the cleaning web, moving means for moving the cleaning unit to one of the cleaning position and the retreat position in accordance with whether the cylinder is in a first or second cleaning mode, and control means for controlling at least one of the first actuator and the moving means in accordance with a position of the cleaning unit to set take-up amounts of the cleaning web to be taken up by the take-up roll in the first and second cleaning modes to be substantially equal to each other.

BRIEF DESCRIPTION OF THE DRAWINGS

FIG. 13 is a side view of the main part of the cylinder cleaning apparatus shown in FIGS. 1A and 6 which shows the take-up state of the cleaning cloth while the cleaning unit is thrown on.

DESCRIPTION OF THE PREFERRED EMBODIMENTS

The preferred embodiments of the present invention will be described with reference to the accompanying drawings.

Figure 1B:
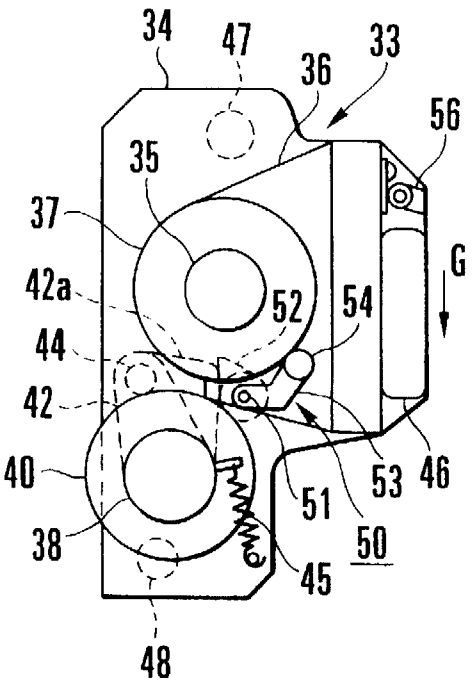
FIG. 1B is a side view of a cleaning unit shown in FIG. 1A.
Figure 1A:
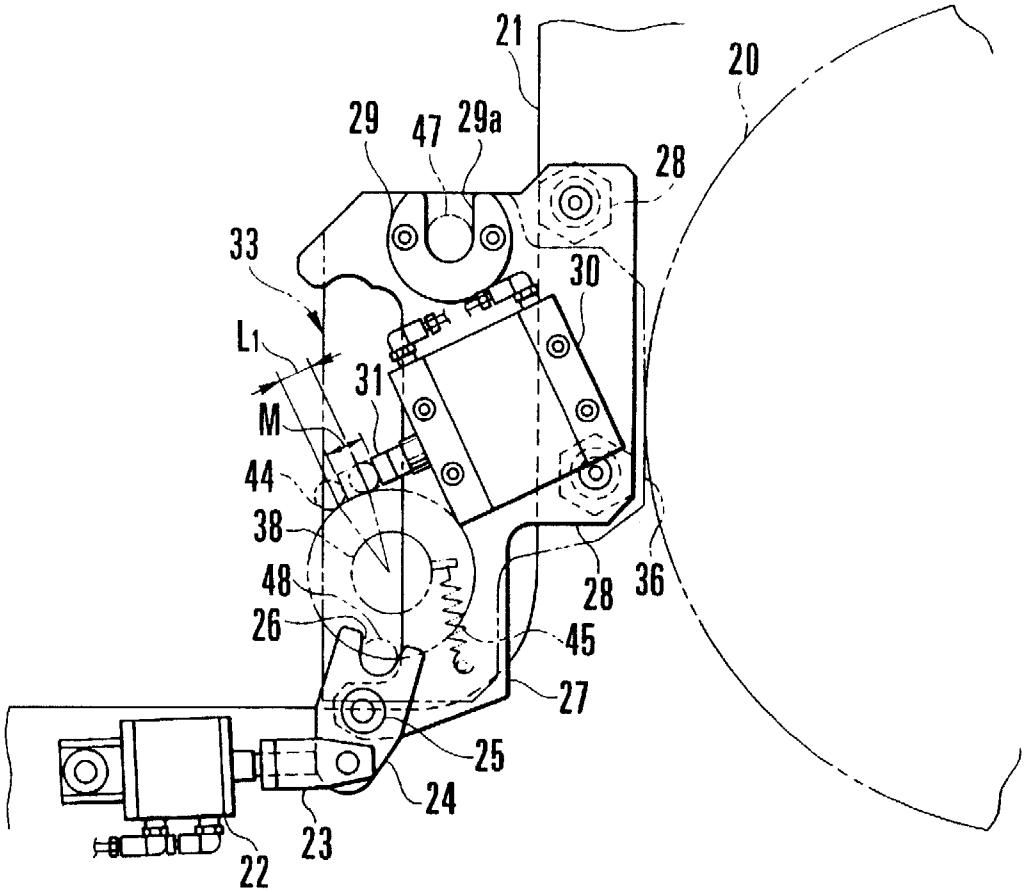
FIG. 1A is a side view showing a cylinder cleaning apparatus for a printing press according to the first embodiment of the present invention.
Figure 2:
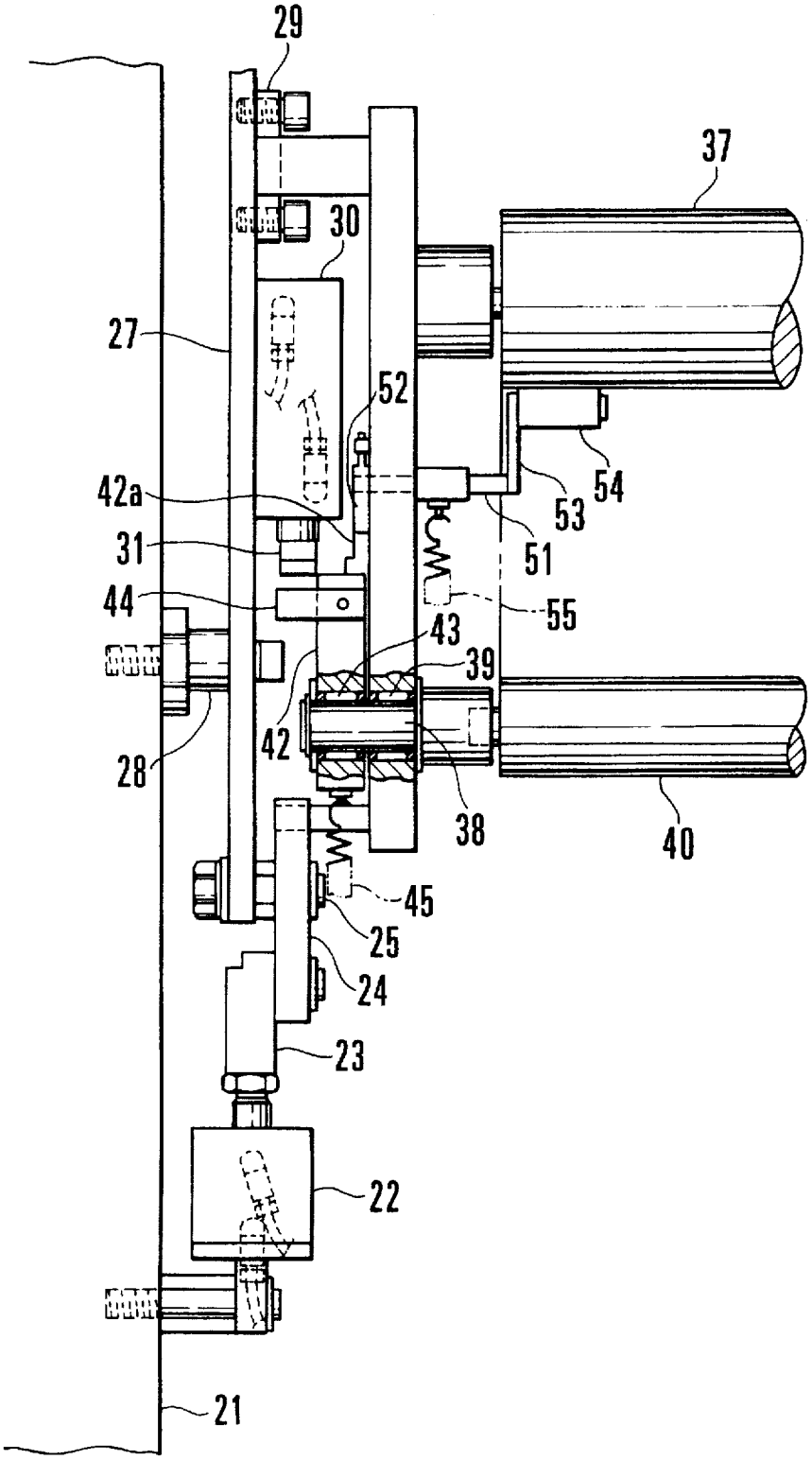
FIG. 2 is an exploded view of the main part of the cylinder cleaning apparatus shown in FIG. 1A which is seen from the front.

FIGS. 1A to 3 explain the entire structure of a cylinder cleaning apparatus for a printing press according to the first embodiment of the present invention. Referring to FIG. 1A, a blanket cylinder 20 is axially supported between a pair of right and left frames 21. A unit throw-on/throw-off actuator 22 has an actuating rod 23 and is pivotally mounted on one of the frames 21. A lever 24 has a proximal end pivotally mounted on the actuating rod 23, a central portion swingably supported by a support shaft 25 extending from a sub-frame 27 to be described later, and a swing end formed with a U-shaped groove 26. The sub-frame 27 is attached to the corresponding frame 21 with a bolt 28. A bearing plate 29 having a U-shaped groove **29*a* is attached to the upper portion of the sub-frame 27. A cloth take-up actuator 30 having a rod 31 is attached to substantially the center of the sub-frame 27**.

Referring to FIG. 1B, a cleaning unit entirely denoted by reference numeral 33 has a pair of right and left side frames 34. A cloth supply shaft 35 is rotatably supported by the side frames 34. A cleaning cloth 36 serving as the cleaning web is wound on the cloth supply shaft 35 to constitute a cleaning cloth supply roll 37. A cloth take-up shaft 38 constitutes a cleaning cloth take-up roll 40. The cleaning cloth take-up roll 40 is axially supported by the side frames 34 to be rotated by the one-way clutch 39 shown in FIG. 2 only counterclockwise, thereby taking up the cleaning cloth 36. A cloth take-up lever 42 is coupled to the cloth take-up shaft 38 through a one-way clutch 43 (shown in FIG. 2) fitted on the cloth take-up shaft 38. When the cloth take-up lever 42 pivots counterclockwise in FIG. 1B, it integrally pivots the cloth take-up shaft 38. When the cloth take-up lever 42 pivots clockwise in FIG. 1A, the pivot force is not transmitted to the cloth take-up shaft 38, and only the cloth take-up lever 42 pivots.

The cloth take-up lever 42 has one side portion integrally formed with a projection **42*a*, and a pin 44 extends vertically on the upper portion of the cloth take-up lever 42. The cloth take-up lever 42 is biased by a tension spring 45 having one end hooked on the corresponding side frame 34 to pivot clockwise in FIG. 1B. The cloth take-up lever 42 engages with a constant amount feed cam 52 to be described later so that its pivot end limit is regulated. An elastic plate 46 urges the cleaning cloth 36 extending between the cleaning cloth supply roll 37 and cleaning cloth take-up roll 40 against the circumferential surface of the blanket cylinder 20. Pins 47 and 48 extend between the upper and lower portions, respectively, of the side frames 34. When the upper pin 47 of the cleaning unit 33 formed in this manner engages in the U-shaped groove 29*a* of the bearing plate 29 of the sub-frame 27, the cleaning unit 33 having the above structure is supported to be swingable about the pin 47 as the center of swing. The lower pin 48 engages in the U-shaped groove 26 of the lever 24**.

A constant amount feed mechanism entirely denoted by reference numeral 50 is constituted by a support shaft 51, a constant amount feed cam 52, and an L-shaped roller arm 53. The support shaft 51 is rotatably supported by the side frames 34. The constant amount feed cam 52 is fixed to the support shaft 51. The roller arm 53 is fixed to the end portion of the support shaft 51 and has a distal end on which a roller 54 is pivotally mounted. A tension coil spring 55 shown in FIG. 2 extends between the constant amount feed cam 52 and the spring hook of the corresponding side frame 34. The tension coil spring 55 applies a pivotal force counterclockwise in FIG. 1B to the roller arm 53 so as to constantly press the roller 54 against the circumferential surface of the cleaning cloth supply roll 37. When the constant amount feed cam 52 is pivoted by the movement of the roller 54 upon reduction of the weight of the cleaning cloth supply roll 37, the pivotal end limit of the cloth take-up lever 42 changes, so that the cleaning cloth 36 is always taken up by the cleaning cloth take-up roll 40 in a constant amount upon one pivot movement of the cloth take-up lever 42. An injection nozzle 56 injects a cleaning liquid to the cleaning cloth 36.

The outline of the cleaning operation in the above arrangement will be described. First, the cleaning liquid is injected by the injection nozzle 56 toward the cleaning cloth 36. Then, the actuating rod 23 of the actuator 22 is retracted and the lever 24 pivots clockwise in FIG. 1A about the support shaft 25 about the center of pivot. By this pivot movement, the cleaning unit 33 pivots counterclockwise about the pin 47 as the center of pivot through the pin 48 engaging in the U-shaped groove 26 of the lever 24 to press the cleaning cloth 36 against the circumferential surface of the blanket cylinder 20, so that the cleaning unit 33 is in contact with the blanket cylinder 20. In this state, when the blanket cylinder 20 is rotated, the foreign matters on the circumferential surface of the blanket cylinder 20 are wiped with the cleaning cloth 36 sprayed with the cleaning liquid. When the blanket cylinder 20 rotates for a predetermined amount and the cleaning cloth 36 gets soiled, the cleaning cloth 36 is taken up by the cloth take-up shaft 38 in a predetermined amount, and a clean portion of the cleaning cloth 36 is supplied to the circumferential surface of the blanket cylinder 20. At this time, whether the cleaning cloth 36 is to be separated or to come into contact with the circumferential surface of the blanket cylinder 20 is selected in accordance with whether the blanket cylinder 20 is in the low-speed state or in the slow-acting state, as described above.

A case will be described wherein both the blanket cylinder 20 and the impression cylinder are to be cleaned simultaneously in the slow-acting state. As shown in FIG. 1A, the cleaning unit 33 is swung to the cleaning position (throw-on state), and the cleaning cloth 36 is taken up while it is in contact with the circumferential surface of the blanket cylinder 20. To take up the cleaning cloth 36, the actuator 30 is actuated to move the rod 31 forward for a stroke amount M. Thus, the pin 44 engaging with the rod 31 also moves for a distance M, so that the cloth take-up lever 42 also pivots counterclockwise in FIG. 1A for a distance M.

Upon the pivot movement of the cloth take-up lever 42, the cloth take-up shaft 38 pivots counterclockwise through the one-way clutch 43 to take up the soiled portion of the cleaning cloth 36 pressed against the circumferential surface of the blanket cylinder 20 onto the cloth take-up shaft 38 for a length $l_1$ as the actuation amount of the actuator 30 and to supply a clean portion of the cleaning cloth 36 from the cleaning cloth supply roll 37. Thereafter, when the rod 31 of the actuator 30 is retracted, the cloth take-up lever 42 is pivoted clockwise in FIG. 1A by the tension coil spring 45 to follow the rod 31. At this time, as the cloth take-up shaft 38 is coupled to the cloth take-up lever 42 through the one-way clutch 43 and supported by the corresponding side frame 34 through the one-way clutch 39, the cloth take-up shaft 38 is regulated from rotating clockwise and is held at a position to which it has been pivoted counterclockwise by the cloth take-up lever 42.

Figure 3:
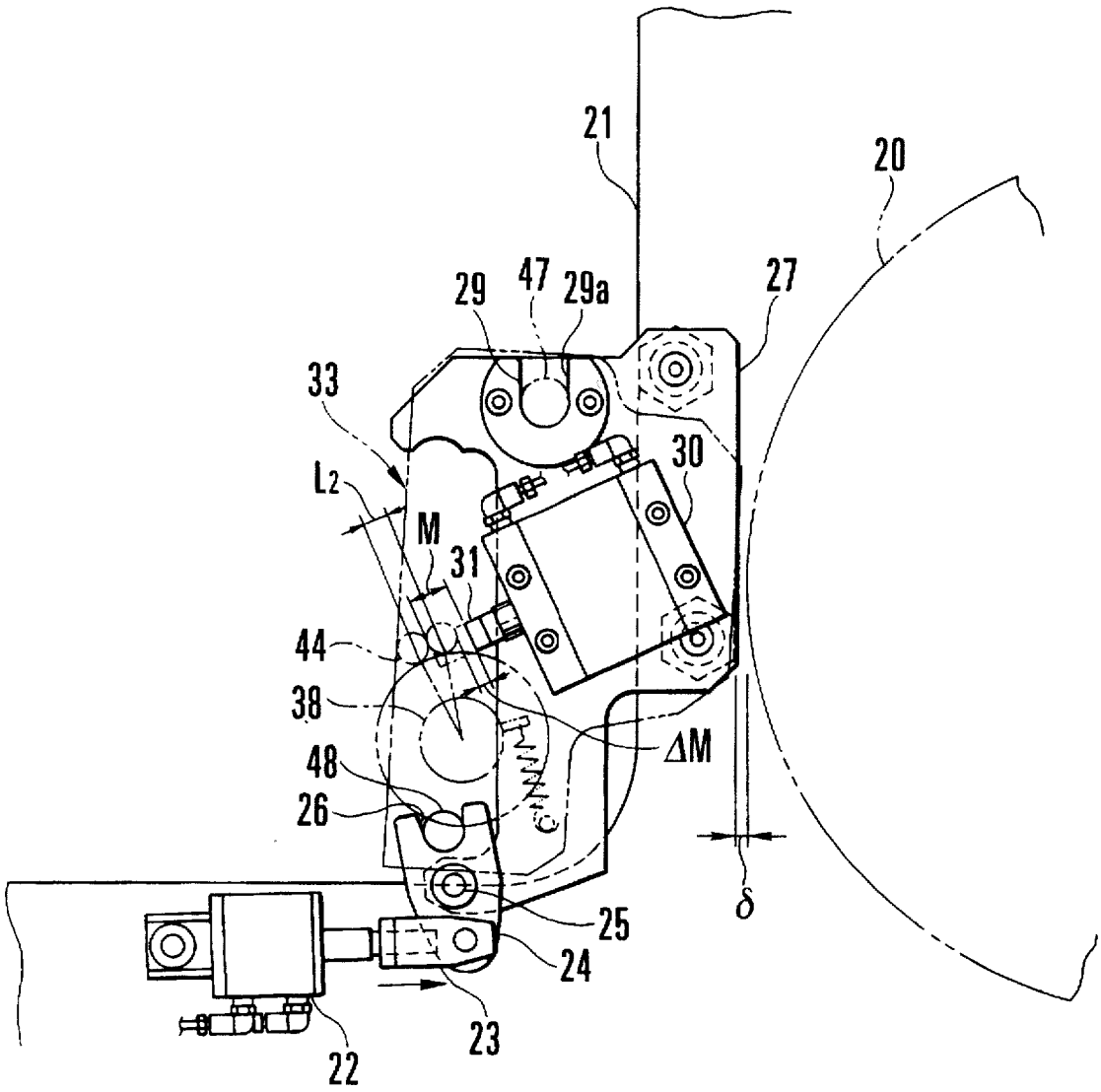
FIG. 3 is a side view showing the operating state of the cylinder cleaning apparatus shown in FIG. 1A.

A case will be described wherein only the blanket cylinder 20 is to be cleaned in the low-speed state. First, the cleaning unit 33 is swung to the retreat position (throw-off state) to separate the cleaning cloth 36 from the circumferential surface of the blanket cylinder 20. More specifically, as shown in FIG. 3, when the actuating rod 23 of the actuator 22 is moved forward, the lever 24 pivots counterclockwise in FIG. 3 about the support shaft 25 as the center. Upon this pivot movement, the cleaning unit 33 pivots clockwise through the pin 48 about the pin 47 as the center, and the cleaning cloth 36 of the cleaning unit 33 is separated from the circumferential surface of the blanket cylinder 20 for a distance δ. At this time, since the actuator 30 is fixed to the sub-frame 27, a gap ΔM is formed between the distal end of the rod 31 of the actuator 30 and the pin 44 of the cloth take-up lever 42, as shown in FIG. 3. In this state, when the actuator 30 is actuated to move the rod 31 forward for a stroke amount M, the pin 44 moves for distance corresponding to (M−ΔM), and the cloth take-up shaft 38 pivots for an amount corresponding to the distance (M−ΔM) to take up the cleaning cloth 36 for a length $l_2$ as the actuation amount of the actuator 30. This take-up length $l_2$ in the low-speed state is smaller than the take-up length $l_1$ in the slow-acting state, which is equal to that in the conventional case.

Figure 4:
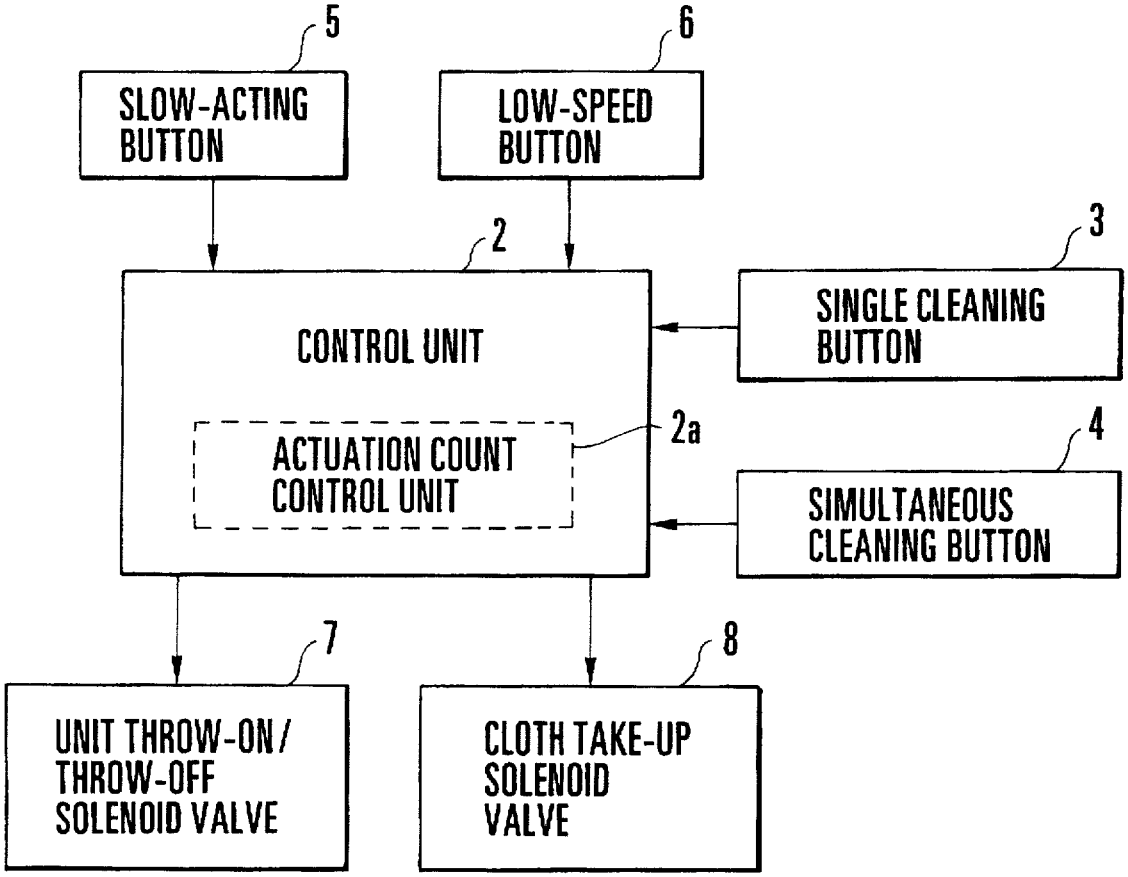
FIG. 4 is a block diagram showing the electrical arrangement of the cylinder cleaning apparatus shown in FIG. 1A.

FIG. 4 shows the electrical arrangement of the cylinder cleaning apparatus described above. Referring to FIG. 4, a control unit 2 controls the operation of the cylinder cleaning apparatus and has an actuation count control unit **2*a* for controlling the actuation count of the actuator 22. A single cleaning button 3 instructs single cleaning of the blanket cylinder 20. A simultaneous cleaning button 4 instructs simultaneous cleaning of the blanket cylinder 20 and the impression cylinder. A slow-acting button 5 instructs the printing press to operate in the slow-acting state. A low-speed button 6 instructs the printing press to operate in the low-speed state. A unit throw-on/throw-off solenoid valve 7 actuates the actuator 22. A cloth take-up solenoid valve 8 actuates the actuator 30**.

Figure 5:
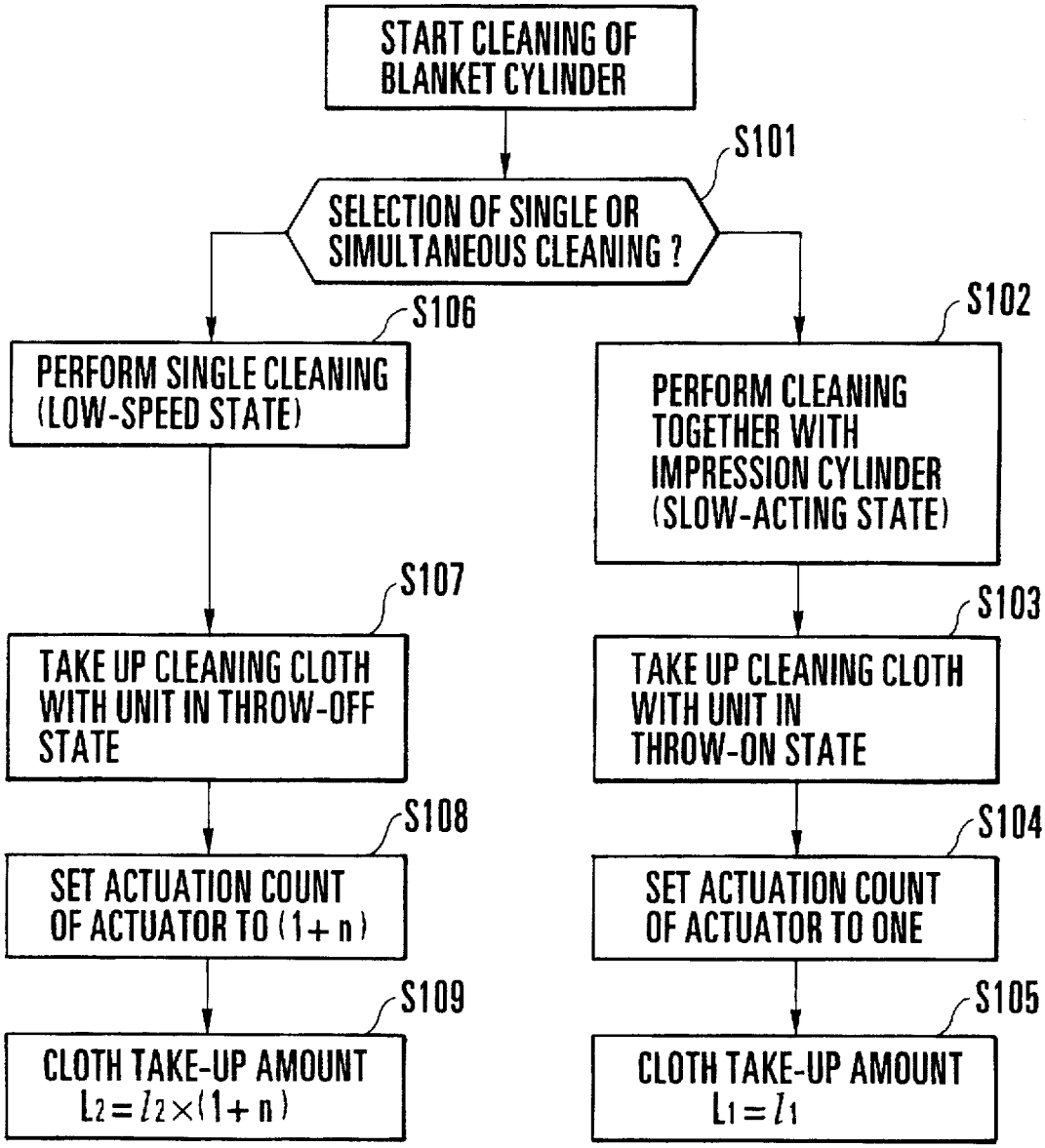
FIG. 5 is a flow chart for explaining the operation of the cylinder cleaning apparatus shown in FIGS. 1A and 4.

The control operation during cleaning will be described with reference to the flow chart of FIG. 5. First, the control unit 2 selects the cleaning mode by monitoring the combination of the single cleaning button 3 and the simultaneous cleaning button 4 with the slow-acting button 5 and the low-speed button 6 (step S101). When the operations of the simultaneous cleaning button 4 and the slow-acting button 5 are detected, the control unit 2 starts the simultaneous cleaning operation for the blanket cylinder and the impression cylinder (step S102). During cleaning, the control unit 2 causes the cleaning cloth 36 to come into contact with the blanket cylinder 20 and takes it up (step S103) while the cleaning unit 33 is swung to the cleaning position (the unit throw-on state shown in FIG. 1A). More specifically, the control unit 2 turns on the cloth take-up solenoid valve 8 to actuate the actuator 30, thereby taking up the cleaning cloth 36. At this time, the take-up amount of the cloth taken up by the cleaning cloth take-up roll 40 upon one cycle of the forward/backward movement of the rod 31 of the actuator 30 is $l_1$. The actuation count control unit **2*a* of the control unit 2 sets the actuation count of the actuator 30 to one in accordance with the selection result in step S101 (step S104). Thus, a take-up amount $L_1$ of the cleaning cloth 36 taken up by the cleaning cloth take-up roll 40 is $L_1=l_1$ (step S105**).

A cleaning operation in the low-speed state will be described. When the combined operation of the single cleaning button 3 and low-speed button 6 is detected in step S101, the control unit 2 starts the single cleaning operation for the blanket cylinder 20 (step S106). During cleaning, the control unit 2 turns on the unit throw-on/throw-off solenoid valve 7 to actuate the actuator 22, thereby swinging the cleaning unit 33 from the cleaning position to the retreat position (unit throw-off state shown in FIG. 3), and then turns on the cloth take-up solenoid valve 8 to actuate the actuator 30, thereby taking up the cleaning cloth 36 (step S107). At this time, the take-up amount of the cloth taken up by the cleaning cloth take-up roll 40 upon one cycle of the forward/backward movement of the rod 31 of the actuator 30 is $l_2$. The actuation count control unit **2*a* of the control unit 2 sets the actuation count of the actuator 30 to (1+n) in accordance with the selection result in step S101 (step S108). Thus, a take-up amount $L_2$ of the cloth taken up by the cleaning cloth take-up roll 40 is $L_2=l_2\times(1+n)$ (step S109). More specifically, although the take-up amount obtained upon one actuation cycle of the actuator 30 is $l_2<l_1$, substantially $L_2=L_1$ is obtained by actuating the actuator 30 for an extra count of n in the low-speed state. As a result, the insufficient cloth take-up amount of the cleaning cloth 36 per time of the cleaning unit 33 in the low-speed state is compensated for by the actuation count of the actuator 30 to substantially achieve $L_2=L_1$. Thus, a clean portion of the cleaning cloth 36** can be supplied for the same amount both in the low-speed state and in the slow-acting state.

Although the number of cycles of the forward/backward movement of the rod 31 of the actuator 30 in step S105 is one for the sake of descriptive convenience in the above embodiment, this number of cycles can be two or more, as a matter of course. In this case, if the ratio of actuation amounts per time of the actuator 30 in the two cleaning modes is 3:2, the ratio of actuation count of the actuator 30 may be set to 2:3.

Figure 6:
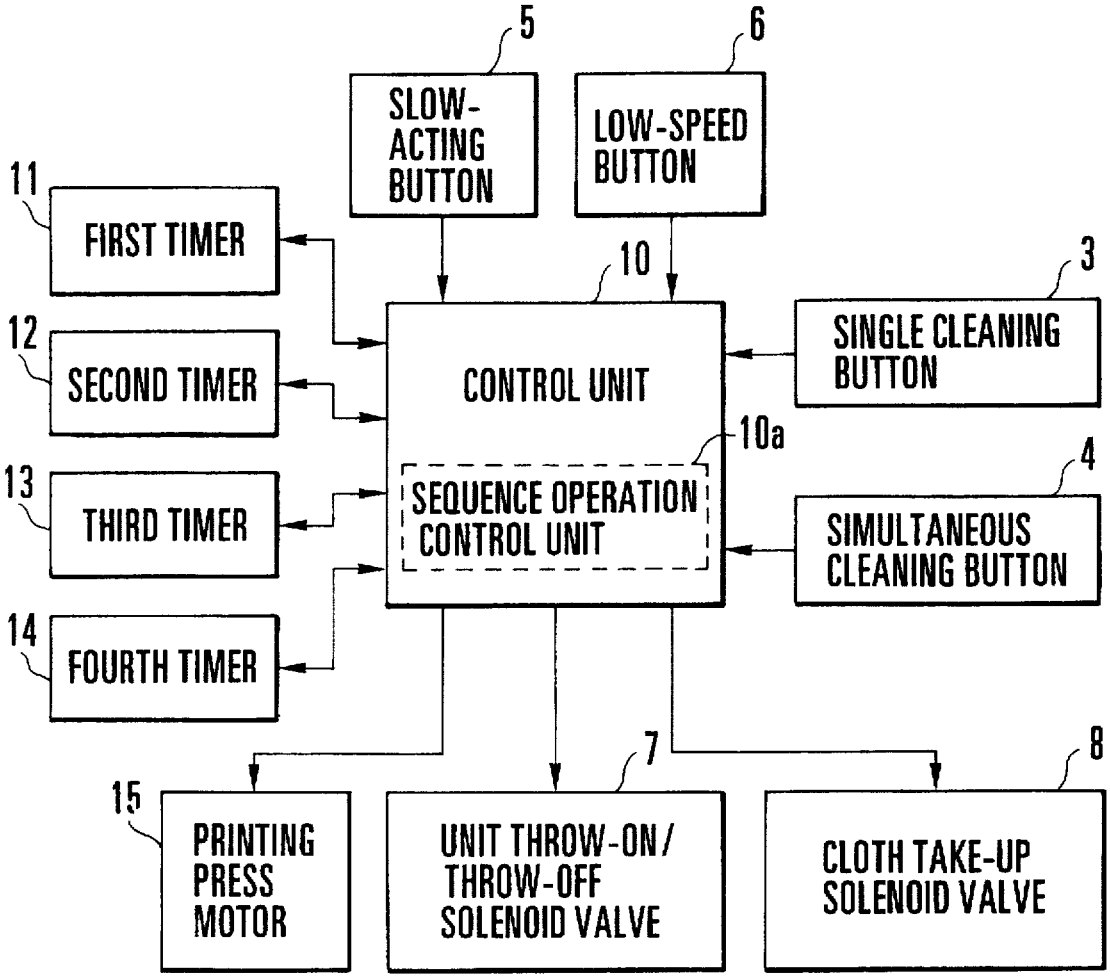
FIG. 6 is a block diagram showing the electrical arrangement of a cylinder cleaning apparatus for a printing press according to the second embodiment of the present invention having the structure shown in FIG. 1A.
Figure 7:
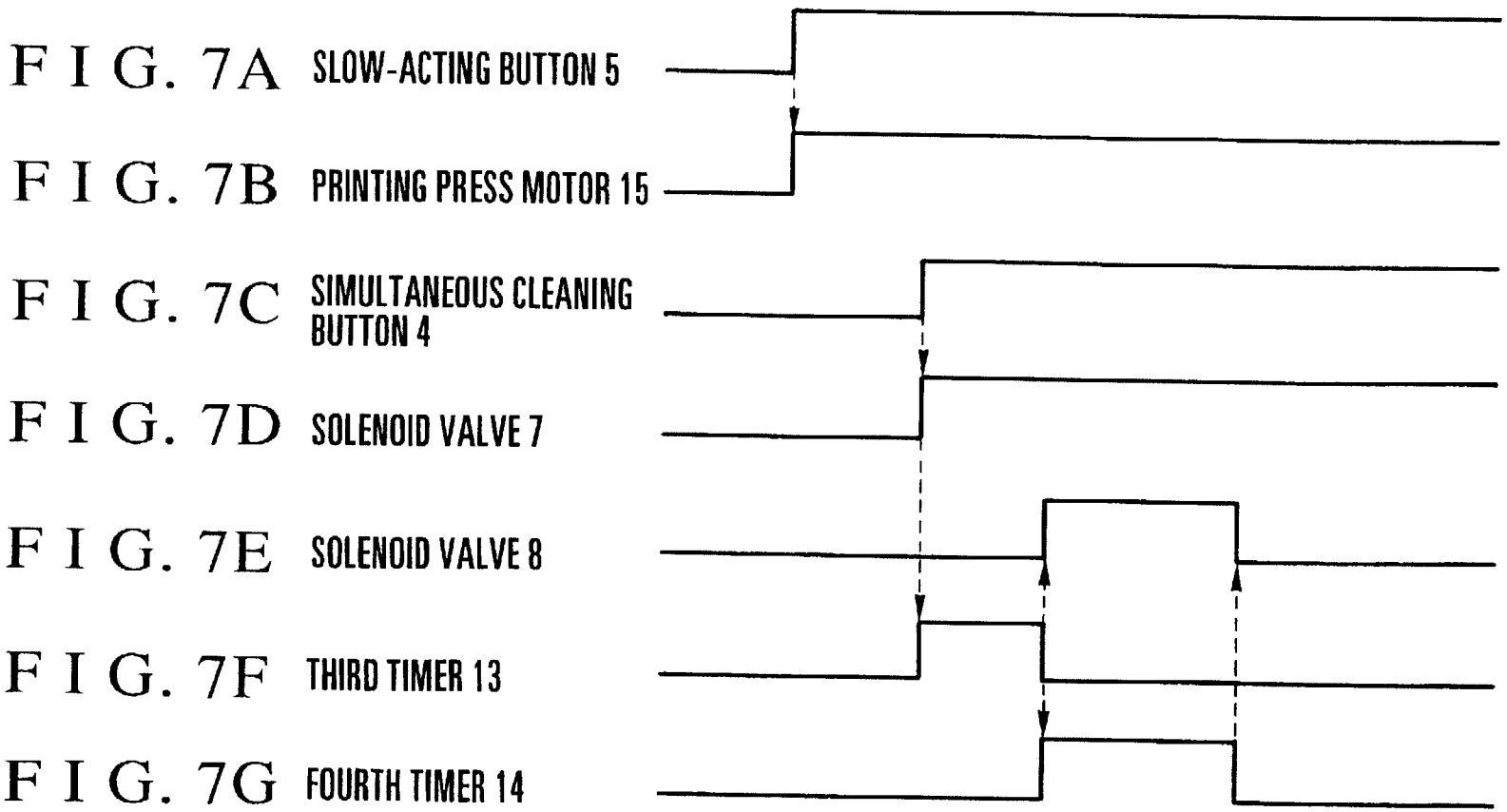
FIGS. 7A to 7G are timing charts for explaining the simultaneous cleaning operation of the cylinder cleaning apparatus shown in FIGS. 1A and 6.
Figure 8:
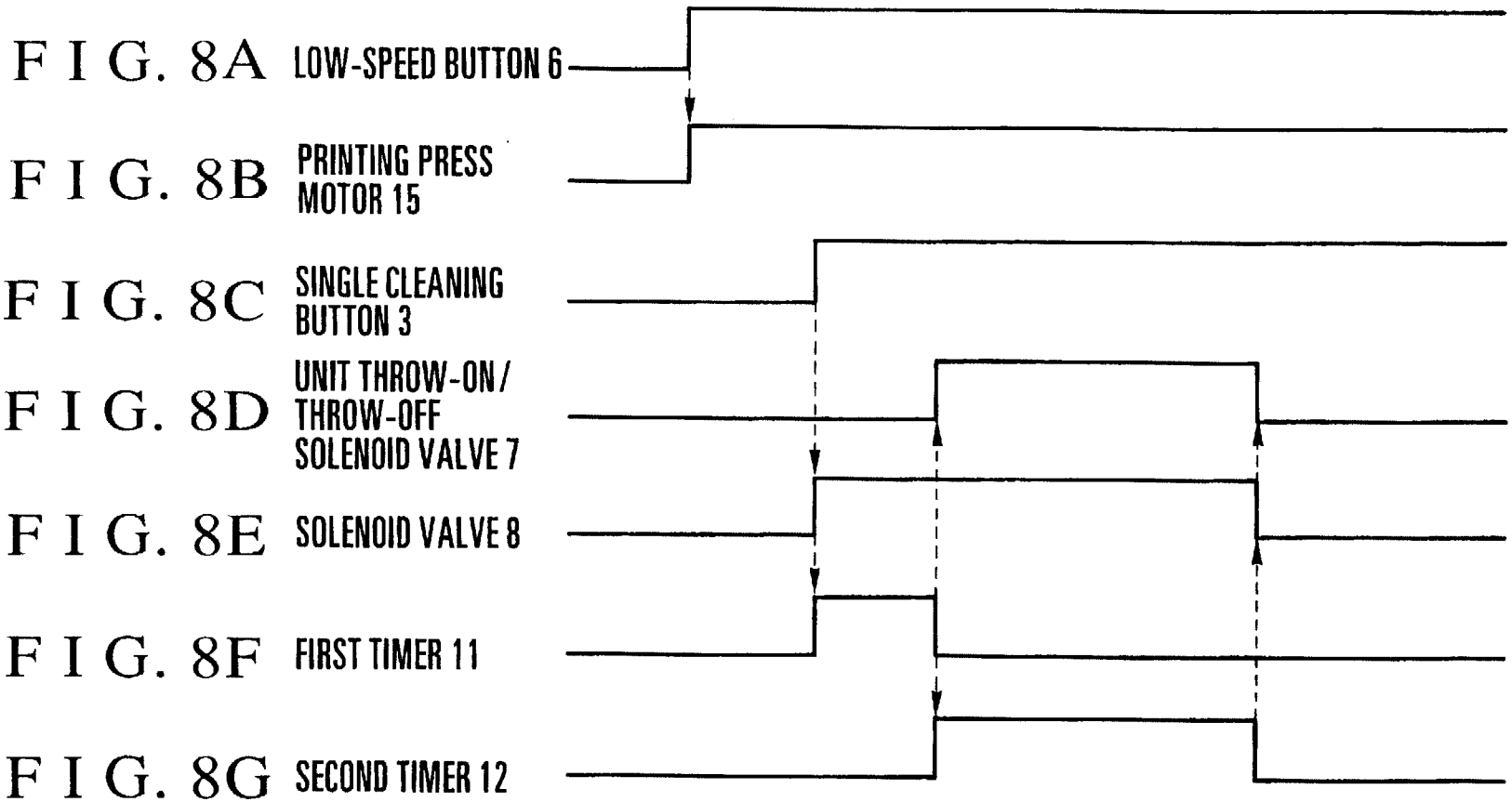
FIGS. 8A to 8G are timing charts for explaining the single cleaning operation of the cylinder cleaning apparatus shown in FIGS. 1A and 6.

FIG. 6 shows the electrical arrangement of a cylinder cleaning apparatus according to the second embodiment of the present invention. The second embodiment has the structure of FIGS. 1A to 3 which is identical to that of the first embodiment.

Referring to FIG. 6, a control unit 10 controls the operation of the cylinder cleaning apparatus, and has a sequence operation control unit 10a for operating actuators 22 and 30 in a composite manner during cleaning when a cleaning unit 33 is located at the retreat position. A first timer 11 is started upon operation of a single cleaning button 3 when cleaning is performed in the low-speed state, to set the off timing of a unit throw-on/throw-off solenoid valve 7. A second timer 12 is started upon time-up of the first timer 11 when cleaning is performed in the low-speed state, to set the off timing of the unit throw-on/throw-off solenoid valve 7 and a cloth take-up solenoid valve 8. A third timer 13 is started upon operation of a simultaneous cleaning button 4 when cleaning is performed in the slow-acting state, to set the on timing of the cloth take-up solenoid valve 8. A fourth timer 14 is stared upon time-up of the third timer 13 when cleaning is to be performed in the slow-acting state, to set the off timing of the cloth take-up solenoid valve 8. A printing press motor 15 is the motor of this printing press. Other arrangements are identical to those of FIG. 4 and are denoted by the same reference numerals as in FIG. 4.

The cleaning operation of the cylinder cleaning apparatus of the printing press having the above arrangement will be described with reference to FIGS. 7A to 14.

Figure 12:
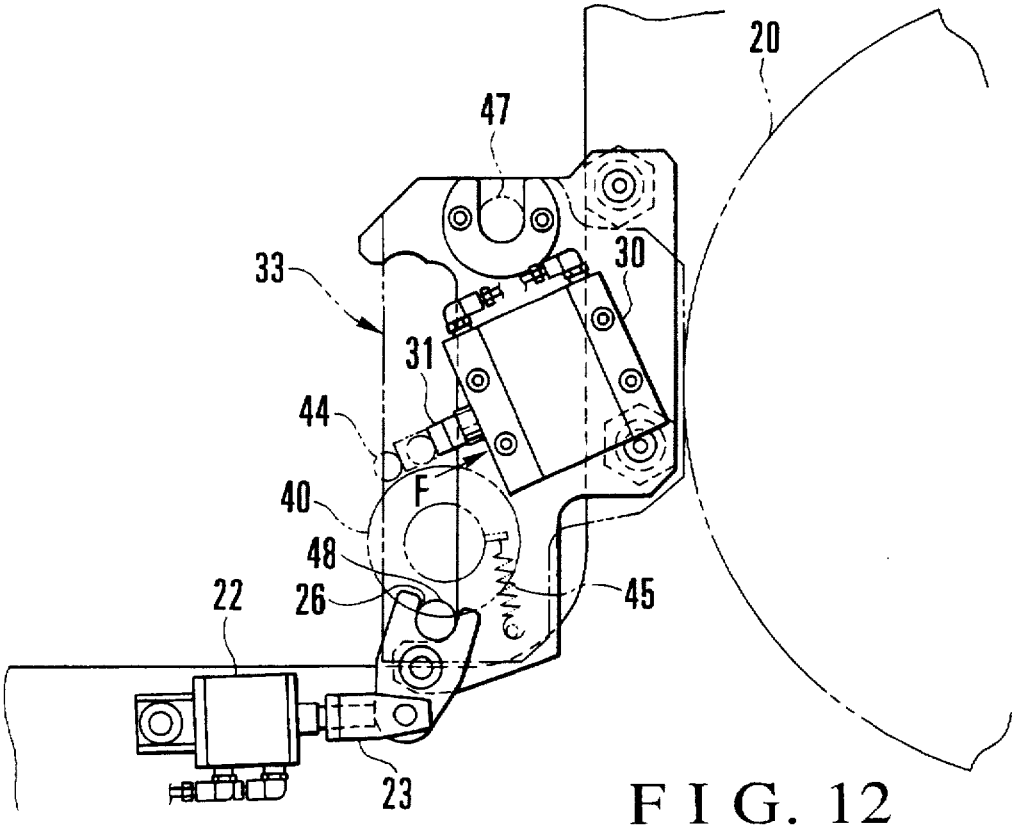
Figure 13:
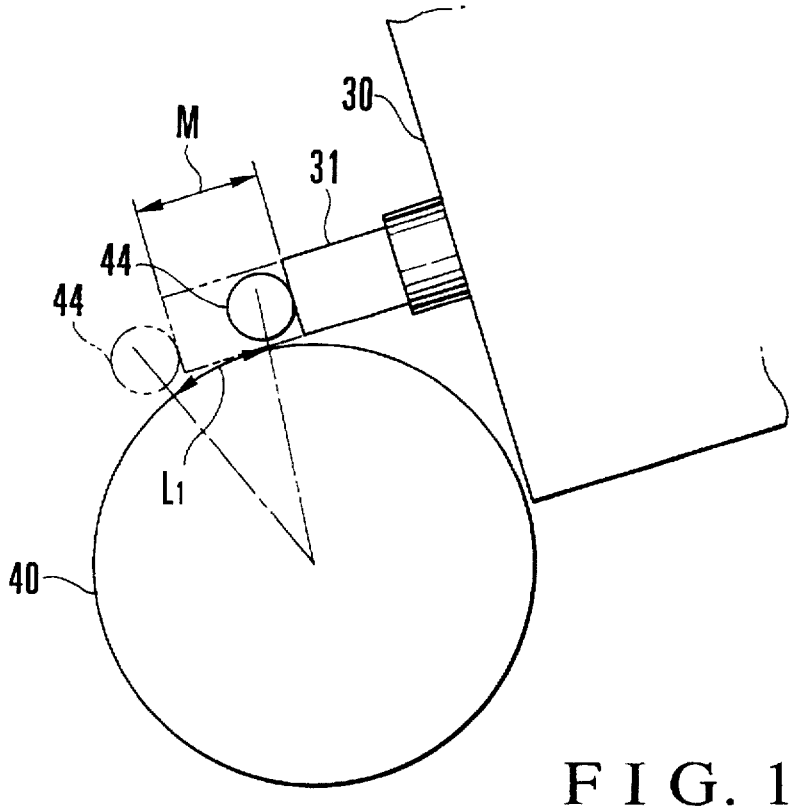

A case will be described wherein both a blanket cylinder 20 and an impression cylinder are to be cleaned simultaneously. When a slow-acting button 5 is operated, as shown in FIG. 7A, the control unit 10 operates the printing press motor 15 in the slow-acting state, as shown in FIG. 7B. When the simultaneous cleaning button 4 is operated, as shown in FIG. 7C, the control unit 10 turns on the unit throw-on/throw-off solenoid valve 7, as shown in FIG. 7D. Upon turning on the solenoid valve 7, a rod 23 of the actuator 22 is moved backward, so that the cleaning unit 33 is thrown on the circumferential surface of the blanket cylinder 20, as shown in FIG. 12. At this time, the distal end of a rod 31 of the actuator 30 is in contact with a pin 44, as shown in FIG. 13.

When the simultaneous cleaning button 4 is operated, the third timer 13 starts counting, as shown in FIG. 7F. When the time set in the third timer 13 has elapsed, the control unit 2 turns on the cloth take-up solenoid valve 8, as shown in FIG. 7E. Upon turning on the solenoid valve 8, the actuator 30 actuates to move the rod 31 forward so as to pivot the pin 44 counterclockwise in FIG. 13, thereby taking up the cleaning cloth on a cleaning cloth take-up roll 40 for a length $l_1$. Upon time-up of the third timer 13, the fourth timer 14 starts counting, as shown in FIG. 7G. When the time set in the fourth timer 14 has elapsed, the control unit 10 turns off the cloth take-up solenoid valve 8, as shown in FIG. 7E, to move the rod 31 of the actuator 30 backward.

Figure 9:
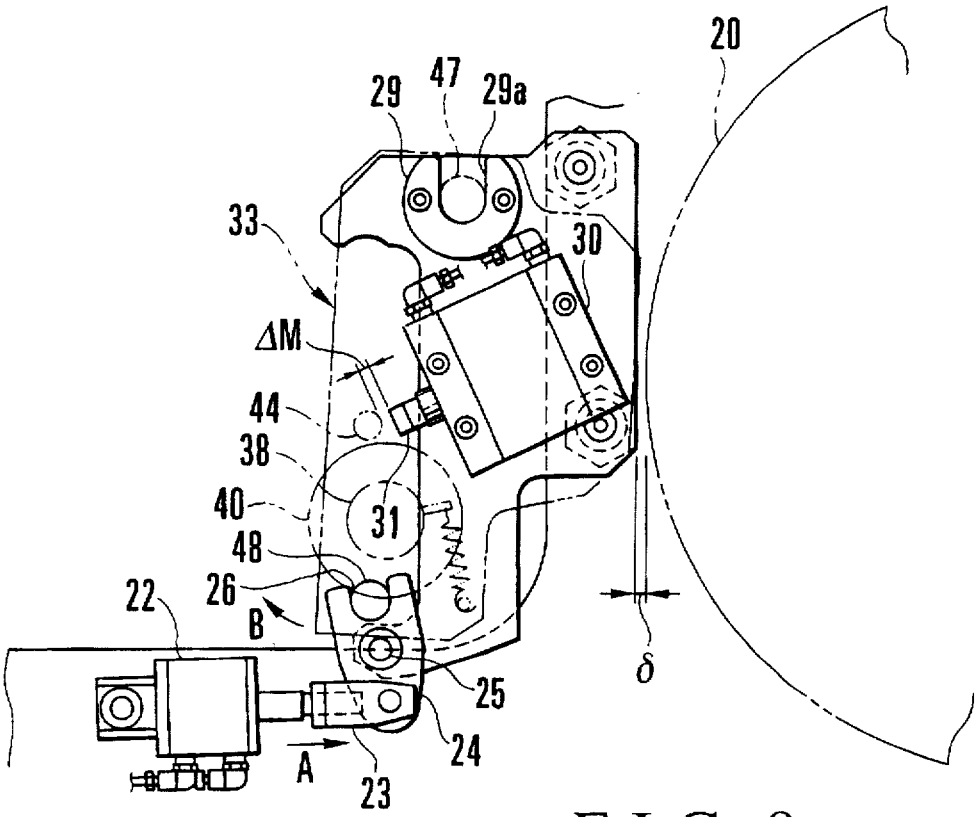
FIGS. 9 to 12 are side views showing the operating state of the cylinder cleaning apparatus shown in FIGS. 1A and 6.
Figure 10:
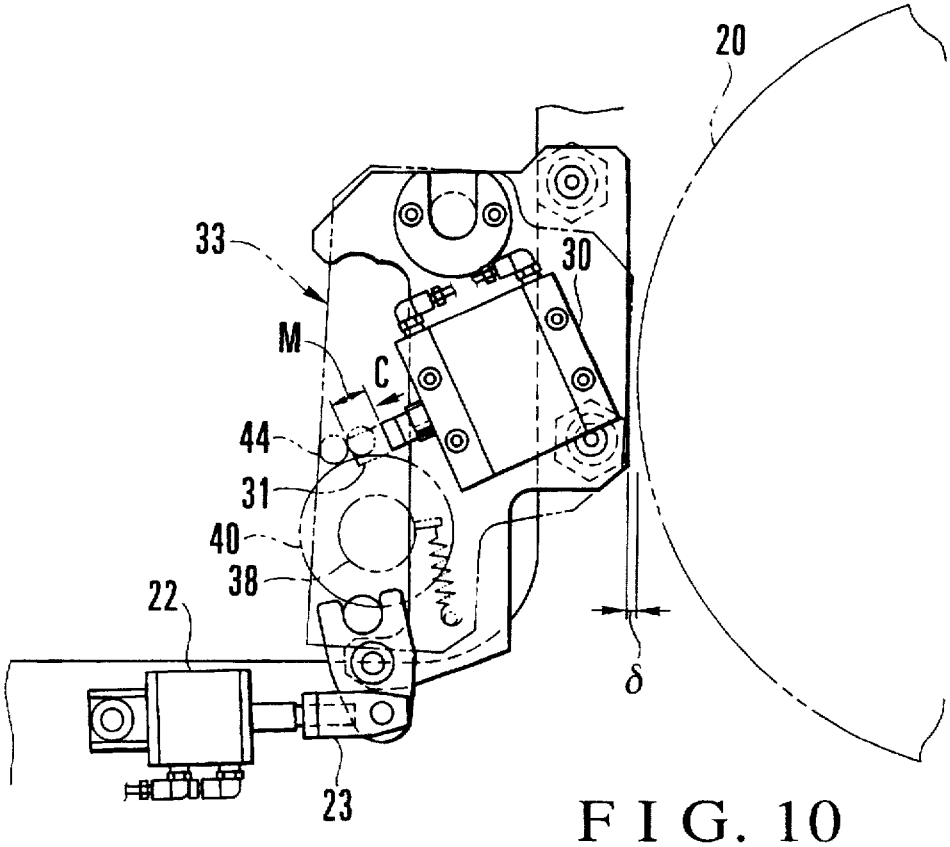
Figure 11:
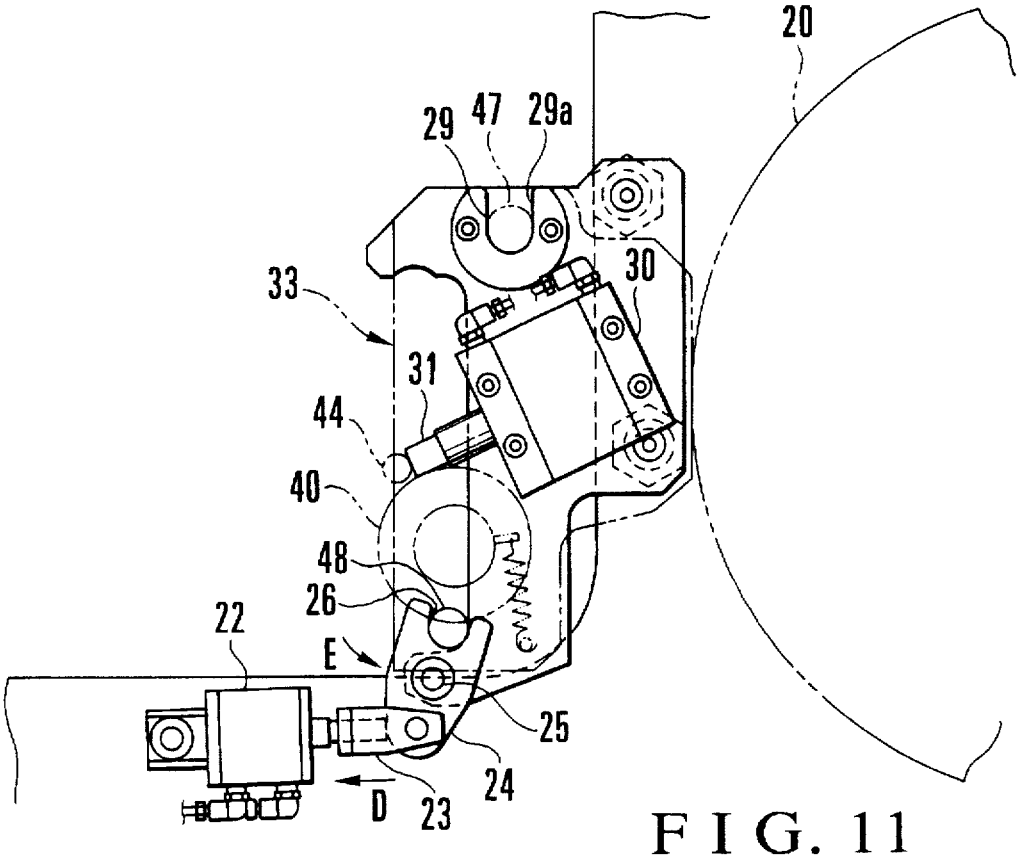
Figure 14:
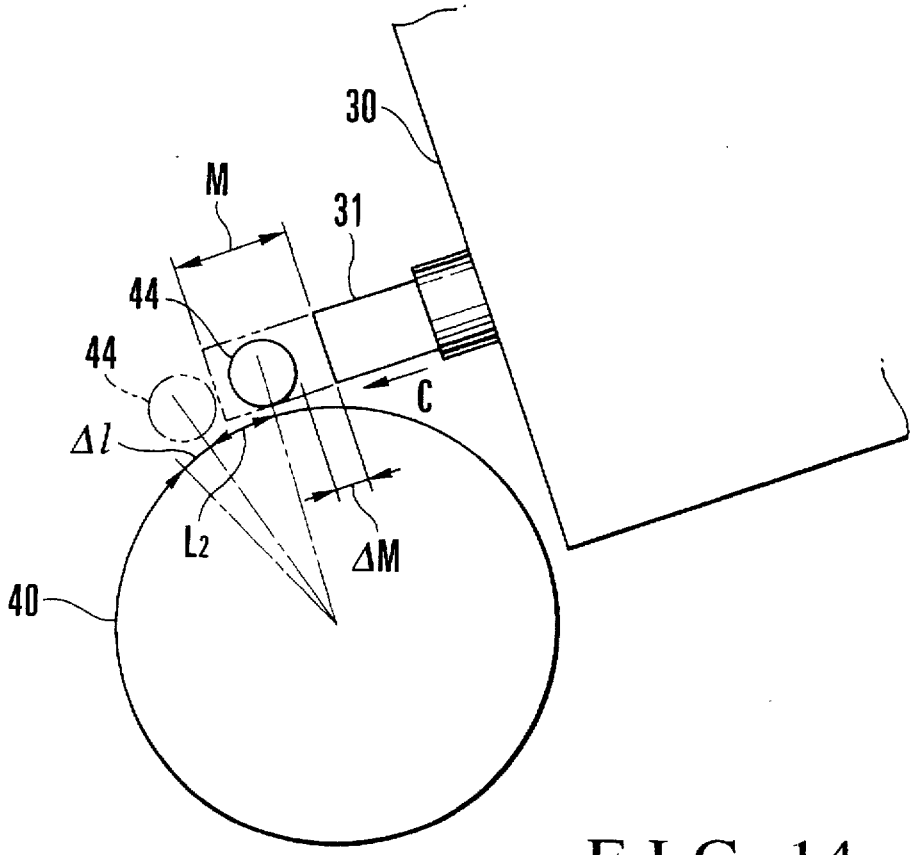
FIG. 14 is a side view of the main part of the cylinder cleaning apparatus shown in FIGS. 1A and 6 which shows the take-up state of the cleaning cloth while the cleaning unit is thrown off.

A case will be described wherein only the blanket cylinder 20 is to be cleaned. When a low-speed button 6 is operated, as shown in FIG. 8A, the control unit 10 operates the printing press motor 15 in the low-speed state, as shown in FIG. 8B. The cleaning unit 33 is set in the so-called throw-off state to be separate from the circumferential surface of the blanket cylinder 20, as shown in FIG. 9, so that it is located at the retreat position. At this time, a gap AM is formed between the distal end of the rod 31 of the actuator 30 and the pin 44, as shown in FIG. 14. When the single cleaning button 3 for cleaning only the blanket cylinder is operated, as shown in FIG. 8C, the control unit 10 turns on the cloth take-up solenoid valve 8, as shown in FIG. 8E. Upon turning on the solenoid valve 8, the rod 31 of the actuator 30 moves forward in a direction C for a stroke amount M, as shown in FIGS. 10 and 14, to pivot the pin 44 counterclockwise. Upon pivot movement of the pin 44, the cleaning cloth is taken up on the cleaning cloth take-up roll 40 for a length $l_2$ ($l_2<l_1$), as shown in FIG. 14.

Upon operation of the single cleaning button 3, the first timer 11 starts counting, as shown in FIG. 8F. When the time set in the first timer 11 has elapsed, the sequence operation control unit 10*a* of the control unit 10 turns on the unit throw-on/throw-off solenoid valve 7, as shown in FIG. 8D, to move the actuating rod 23 of the actuator 22 backward in a direction D in FIG. 11. Thus, the cleaning unit 33 pivots in a direction E in FIG. 11 about a pin 47 as the center of pivot, so that it is thrown on the circumferential surface of the blanket cylinder 20. At this time, since the rod 31 of the actuator 30 remains in the forward state, upon pivot movement of the cleaning unit 33 in the direction E, the pin 44 moves counterclockwise for a distance ΔM, as shown in FIG. 14, to further take up the cleaning cloth on the cleaning cloth take-up roll 40 for a length Δl. In this manner, while the cleaning unit 33 is in the throw-off state, the rod 31 of the actuator 30 is moved forward, and thereafter while the rod 31 is at the forward position, the cleaning unit 33 is set in the throw-on state. Therefore, the cleaning cloth can be taken up under the same conditions as those in the slow-acting state wherein the cleaning cloth is taken up while the cleaning unit 33 is in the throw-on state as described above. More specifically, the length of the cleaning cloth as the sum of the length $l_2$ which is taken up the first and the length Δl which is taken up the second is the same as the take-up length $l_1$ in the slow-acting state wherein the cleaning unit 33 performs the take-up operation in the throw-on state ($l_2+\Delta l=l_1$).

When the time set in the first timer 11 has elapsed, the second timer 12 starts counting, as shown in FIG. 8G. When the time set in the second timer 12 has elapsed, the control unit 10 turns off the cloth take-up solenoid valve 8, as shown in FIG. 8E. Upon turning off the solenoid valve 8, the rod 31 of the actuator 30 is moved backward in a direction F, as shown in FIG. 12. Along with this, the pin 44 is also pivoted clockwise in FIG. 12 by a tension spring 45. Simultaneously, the sequence operation control unit 10*a* of the control unit 10 turns off the unit throw-on/throw-off solenoid valve 7, as shown in FIG. 8D. Thus, the cleaning unit 33 separates from the circumferential surface of the blanket cylinder 20 to be in the throw-off state, as shown in FIG. 9.

In the above embodiments, an impression cylinder is taken as an example of cylinders that are to be cleaned simultaneously with the blanket cylinder 20. However, the present invention is not limited to this, and can be applied to any cylinders, e.g., printing cylinders such as a plate cylinder and a transfer cylinder, and rollers such as a form roller and a vibrating roller, that need cleaning.

In the above embodiments, the cleaning liquid is supplied to the cleaning cloth 36. However, the cleaning liquid may be directly supplied to the circumferential surface of the blanket cylinder 20, or a cleaning cloth impregnated with the cleaning liquid in advance may be used to achieve the same operation and effect as those described above.

In the above embodiments, the cleaning cloth 36 is supplied from the cleaning cloth supply roll 37. However, as a cloth supplying portion, a space for accommodating the cleaning cloth 36 may be formed, and the cleaning cloth 36 may be folded in this space. Various other changes and modifications in design can be made.

As has been described above, according to the present invention, the insufficient take-up amount of the cleaning cloth per time when the cleaning unit is at the retreat position can be compensated for by the actuation count of the actuators. Therefore, a clean portion of the cleaning cloth can be supplied for the same amount both when the cleaning unit is at the cleaning position and at the retreat position without altering the structure. Hence, defective cleaning caused by insufficient supply of the cleaning cloth when the cleaning unit is at the retreat position, or inversely degradation in cleaning cloth supply efficiency caused by excessive supply of the cleaning cloth when the cleaning unit is at the cleaning position can be prevented.

As the take-up amount of the cleaning cloth can be set the same both when the cleaning unit is at the retreat position and at the cleaning position, defective cleaning caused by insufficient cleaning cloth supply when the cleaning unit is at the retreat position can be prevented.

What is claimed is:

1. A cylinder cleaning apparatus for a printing press, comprising:

a cleaning unit supported by a printing press frame, said cleaning unit having a cleaning web, said cleaning unit mounted to be movable between a cleaning position where said cleaning web is in contact with a circumferential surface of a cylinder and a retreat position where said cleaning web is separate from said circumferential surface of said cylinder, said cleaning unit having a supply portion for supplying said cleaning web to said circumferential surface of said cylinder and a take-up roll for taking up said cleaning web supplied from said supply portion, said cleaning unit having a first cleaning mode and a second cleaning mode for cleaning said cylinder in which said cleaning web is taken up;

a first actuator fixed to said printing press frame to pivot said take-up roll, thereby taking up said cleaning web;

moving means coupled to said first actuator for moving said cleaning unit to one of said cleaning position and said retreat position in accordance with whether said cylinder is in one of said first and said second cleaning mode, wherein in said first cleaning mode, said cleaning unit is moved to said cleaning position, and wherein in said second cleaning mode, said cleaning unit is moved to said retreat position; and control means for controlling said first actuator in said first cleaning mode and at least one of said first actuator and said moving means in said second cleaning mode to set take-up amounts of said cleaning web to be taken up by said take-up roll in said first and second cleaning modes to be substantially equal to each other.

2. An apparatus of claim 1, wherein said control means comprises actuation count control means for controlling, with reference to an actuation count of said first actuator in one of the first and second cleaning modes, an actuation count of said first actuator in the other of the first and second cleaning modes.

3. An apparatus of claim 2, wherein said actuation count control means controls actuation counts of said first actuator in the first and second cleaning modes based on a ratio of take-up amounts of said cleaning web obtained upon one cycle of an actuation of said first actuator in the first and second cleaning modes.

4. An apparatus of claim 1, wherein said control means comprises sequence operation control means for actuating said first actuator when said cleaning unit is in the second cleaning mode to move to the retreat position, and thereafter moving said cleaning unit to the cleaning position while said first actuator is kept actuated.

5. An apparatus of claim 4, wherein a take-up amount of said cleaning web obtained upon an actuation of said first actuator in the first cleaning mode is equal to a sum of a take-up amount of said cleaning web obtained upon an actuation of said first actuator in the second cleaning mode and a take-up amount of said cleaning web obtained upon movement of said cleaning unit.

6. An apparatus of claim 1, wherein said moving means comprises a second actuator fixed to said printing press frame and coupled to a swingable end portion of said cleaning unit which is swingably supported on said printing press frame, for biasing said cleaning unit to swing.

7. An apparatus of claim 1, further comprising a take-up lever mounted on a support shaft of said take-up roll, a one-way clutch for transmitting a pivotal force of said take-up lever to said take-up roll in only a take-up direction of said cleaning web, a pin provided to a distal end of said take-up lever, a rod driven by said first actuator to reciprocate, said rod pivoting said take-up lever when a distal end thereof abuts against said pin, and a spring for returning said take-up lever to a take-us starting position upon a backward movement of said rod.

8. An apparatus of claim 1, wherein said first cleaning mode is a low speed mode and wherein said second cleaning mode is a slow-acting mode.

9. The cylinder cleaning apparatus of claim 1, wherein said first cleaning mode is a low-speed state and said second cleaning mode is a slow-acting state.

10. A cylinder cleaning apparatus for a printing press, comprising;

a cleaning unit supported by a printing press frame, said cleaning unit having a cleaning web, said cleaning unit mounted to be movable between a cleaning position where a cleaning web is in contact with a circumferential surface of a cylinder and a retreat position where said cleaning web is separate from said circumferential surface of said cylinder, said cleaning unit having a supply portion for supplying said cleaning web to said circumferential surface of said cylinder and a take-up roll for taking up said cleaning web supplied from said supply portion, said cleaning unit having a first cleaning mode and a second cleaning mode for cleaning said cylinder in which said cleaning web is taken up;

an actuator fixed to said printing press frame to pivot said take-up roll for a predetermined amount, thereby taking up said cleaning web;

moving means for moving said cleaning unit to one of said cleaning position and said retreat position in accordance with whether said cylinder is in one of said first and said second cleaning mode, wherein in said first cleaning mode, said cleaning unit is moved to said cleaning position, and wherein in said second cleaning mode, said cleaning unit is moved to said retreat position; and control means coupled to said actuator for controlling an actuation count of said actuator in accordance with a position of said cleaning unit to set take-up amounts of said cleaning web to be taken up by said take-up roll in said first and second cleaning modes to be substantially equal to each other.

11. An apparatus of claim 10, wherein said actuation count control means controls actuation counts of said actuator in the first and second cleaning modes based on a ratio of take-up amounts of said cleaning web obtained upon one cycle of an actuation of said actuator in the first and second cleaning modes.

12. An apparatus of claim 10, wherein said first cleaning mode is a low speed mode and wherein said second cleaning mode is a slow-acting mode.

13. The cylinder cleaning apparatus of claim 10, wherein said first cleaning mode is a low-speed state and said second cleaning mode is a slow-acting state.

14. A cylinder cleaning apparatus for a printing press, comprising:

a cleaning unit supported by a printing press frame, said cleaning unit having a cleaning web, said cleaning unit mounted to be movable between a cleaning position where a cleaning web is in contact with a circumferential surface of a cylinder and a retreat position where said cleaning web is separate from said circumferential surface of said cylinder, said cleaning unit having a supply portion for supplying said cleaning web to said circumferential surface of said cylinder and a take-up roll for taking up said cleaning web supplied from said supply portion, said cleaning unit having a first cleaning mode and a second cleaning mode for cleaning said cylinder in which said cleaning web is taken up;

an actuator fixed to said printing press frame to pivot said take-up roll for a predetermined amount, thereby taking up said cleaning web;

moving means coupled to said actuator for moving said cleaning unit to one of said cleaning position and said retreat position in accordance with whether said cylinder is in one of said first and said second cleaning mode, wherein in said first cleaning mode, said cleaning unit is moved to said cleaning position, and wherein in said second cleaning mode, said cleaning unit is moved to said retreat position; and control means for actuating said actuator when said cleaning unit is in the second cleaning mode to move to said retreat position, and thereafter moving said cleaning unit to said cleaning position while said actuator is kept actuated.

15. An apparatus of claim 14, wherein the take-up amount of said cleaning web obtained upon actuation of said actuator in the first cleaning mode is equal to a sum of a take-up amount of said cleaning web obtained upon actuation of said actuator in the second cleaning mode and a take-up amount of said cleaning web obtained upon movement of said cleaning unit.

16. An apparatus of claim 14, wherein said first cleaning mode is a low speed mode and wherein said second cleaning mode is a slow-acting mode.

17. The cylinder cleaning apparatus of claim 14, wherein said first cleaning mode is a low-speed state and said second cleaning mode is a slow-acting state.

* * * * *